United States Patent [19]

van Wersch

[11] Patent Number: 4,644,601

[45] Date of Patent: Feb. 24, 1987

[54] METHOD AND APPARATUS FOR APPLYING EVAPORABLE FINISHING MEANS OR TEXTILE MATERIAL

[75] Inventor: Kurt van Wersch, Wegberg, Fed. Rep. of Germany

[73] Assignee: A. Monforts GmbH & Co., Monchen-Gladbach, Fed. Rep. of Germany

[21] Appl. No.: 698,178

[22] Filed: Jan. 10, 1985

[51] Int. Cl.[4] ..... D06B 1/02

[52] U.S. Cl. ..... 8/149.2; 8/158

[58] Field of Search ..... 8/636, 930, 932, 147–159, 8/471, 472, 63; 427/255.5, 255.6, 316

[56] References Cited

U.S. PATENT DOCUMENTS

| | | | |
|---|---|---|---|
| 1,895,243 | 1/1933 | Dort | 8/149.2 X |
| 3,129,054 | 4/1964 | Robbart | 427/255.6 X |
| 4,406,662 | 9/1983 | Beran et al. | 8/471 |

FOREIGN PATENT DOCUMENTS

| | | | |
|---|---|---|---|
| 931441 | 8/1973 | Canada | 427/255.5 |

*Primary Examiner*—Philip R. Coe

*Attorney, Agent, or Firm*—Herbert L. Lerner; Laurence A. Greenberg

[57] ABSTRACT

Applying evaporable finishing substances such as high-refinement media, dyes and optical brighteners, by evaporating the finishing substance and transferring to the textile material in the vapor phase via a line system. Smudging or smearing and re-evaporation of the vapor-deposited material in a continuously operating finishing system is avoided according to the invention by heating the textile material prior to the vapor deposition to a treatment temperature above the evaporation temperature and by using a finishing substance with a dew point in the finishing substance/transport mixture below the treatment temperature of the textile material.

2 Claims, 1 Drawing Figure

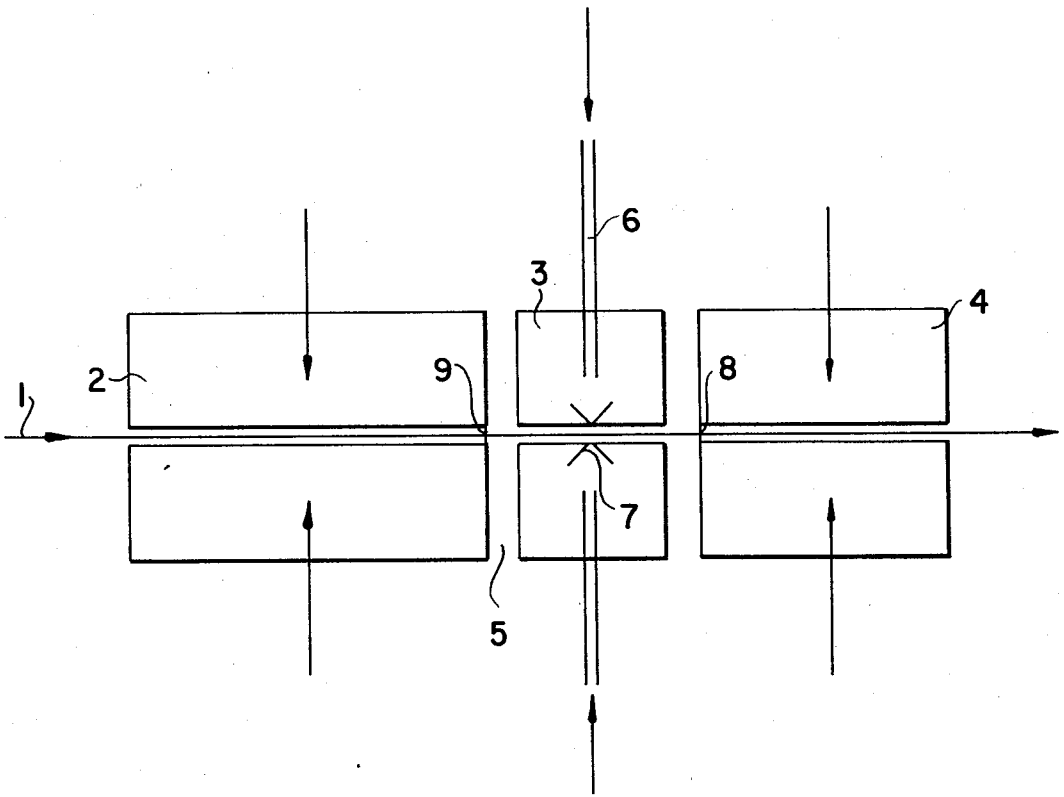
1
2
3
4
5
6
7
8
9

METHOD AND APPARATUS FOR APPLYING EVAPORABLE FINISHING MEANS OR TEXTILE MATERIAL

BACKGROUND OF THE INVENTION

1. Field of the Invention

The invention relates to a method for finishing textile material containing synthetic fibers, especially a web of textile material with evaporable finishing means which form a solid solution with the material of the synthetic fibers, and in which the finishing means are evaporated and are transferred in the vaporous phase to the textile material by means of a carrier gas. The term "evaporable finishing means" is understood to mean in the present context processing agents, dyes, optical brighteners and similar treatment agents used in the textile industry for textile material in fiber, thread, sheet or web form. The term "textile material" refers primarily the above-mentioned categories.

2. Description of the Prior Art

In the journals "Journal of the Society of Dyers and Colourists", Vol. 82, September 1966, pages 333 to 338, as well as "Melliand Textilberichte", 1972, pages 1265 to 1270, and 1977, pages 844 to 850, a method is described, in which a pure dispersion dye which does not contain additives such as adulterants and dispersion agents, is heated, melted and evaporated as well as transferred in this state directly to a substrate. Since the speed with which the dye changes into the vapor phase, depends on the size of the dye particles and increases as the square with decreasing particle diameter, monomolecular dyes have a relatively high partial vapor pressure in the melted, liquid state.

If a textile material is to be finished by the known method, the vapor deposition would have to be followed by a treatment process, in which the vapor-deposited finishing agent diffuses into the individual textile fiber. Up to the completion of this treatment process proper, however, there is the danger of the substance applied to the textile material to smudge or blur, as in the conventional dye-fixing from the liquid phase. In vapor-depositing pure dye in a continuously operating treatment unit, the further disadvantage can be expected that in the time between the beginning and the end of the fixing operation following the vapor deposition, a considerable part of the just vapor-deposited material is not bound in contrast to the present dyeing process from the liquid phase as a result the vapor-deposited material, evaporates again from the substrate and is lost and even contaminates not only the parts of the machine which are to be kept clean but also the exhaust air.

In this category a method of the kind can be found in the older DE-OS No. 32 18 142. It is attempted with this method to make the intermediate carrier required in the transfer printing method described, for instance, in DE-OS No. 23 12 418, unnecessary. In transfer printing, the dye, with or without intermediate carrier, is transferred from the gaseous phase by resublimation to the textile material, paper or the like. If, for instance, dispersion dyes are to be applied to polyethylene fibers, a process step must again follow, in which the dye must be fixed on or in the fiber. In fixing, the dye is dissolved in the evaporated state in the respective synthetic fiber.

The finishing, and especially the dyeing of synthetic fibers, for instance, polyethylene fibers with dispersion dyes, also takes place in the so-called thermosol process, in which the dye is applied to the textile material in dissolved form. In this method, drying takes place first after the dissolved finishing agent is padded and then, the textile material is heated in a fixing stage to a high temperature and for a sufficient length of time to diffuse. the dye "in gaseous condition" into the individual textile fibers and form with the material of the fibers a so-called solid solution.

It is a disadvantage of the older methods that a separate process step requiring thermal energy is required for dissolving and fixing. However, it is even more disturbing in practice that up to the conclusion of the dissolving process the danger of smudging and blurring of the substance applied to the textile material exists in the modified transfer printing method (which does not require an intermediate carrier) as well as in the thermosol method.

SUMMARY OF THE INVENTION

With the foregoing and other objects in view, there is provided in accordance with the invention a method for finishing textile material containing synthetic fibers, especially a web of textile cloth, with an evaporable finishing medium forming a solid solution with the material of the synthetic fibers, wherein the finishing medium is evaporated and is transferred to the textile material in the vapor phase by means of a carrier gas, the combination therewith of heating the textile material prior to making contact with the evaporated finishing substance, to the treatment temperature required for dissolving the finishing substance in the synthetic fiber and using a finishing substance with a dew point in the finishing substance gas transport mixture below the treatment temperature of the textile material.

An apparatus for finishing textile material containing synthetic fibers, especially a web of textile cloth, with an evaporable finishing medium forming a solid solution with the material of the synthetic fibers, wherein the finishing medium is evaporated and is transferred to the textile material in the vapor phase by means of a carrier gas, comprises, a continuously operating treatment unit for treating the textile material, said treatment unit including a finishing machine which extends in the travel direction of the textile material, heating means for heating the textile material during its passage through the finishing machine prior to making contact with the evaporated finishing substance to the temperature required for dissolving the finishing substance in the synthetic fiber, an application system for the application of finishing substance vapor to the textile material, which system is integrated into the treatment path of the textile material, said application system having a separate feed-line for the introduction of the finishing substance carrier gas mixture and a separate discharge line for the discharge of said mixture onto the textile material.

BRIEF DESCRIPTION OF THE DRAWING

The accompanying drawing diagrammatically illustrates a continuously operating unit in which textile material first passes through a heating-up zone, then through a vapor deposition zone wherein it receives a finishing substance, and then to a post-treatment zone after which it is discharged.

DETAILED DESCRIPTION OF THE INVENTION

It is an object of the invention to provide a method which can be employed in a continuous textile treatment process and in which smudging or smearing cannot occur for all practical purposes.

The solution according to the invention consists in that the textile material, before it comes into contact with the evaporated finishing substance, is heated to the treatment temperature required for dissolving the finishing substance in the synthetic fiber, and that a finishing substance with a dew point below the treatment temperature of the textile material is used in the finishing substance/carrier gas mixture. This means that the evaporation temperature of the finishing substance should be below the treatment temperature, for instance, the fixation temperature, of the textile material, or that the textile material must be heated, prior to the vapor deposition, to a treatment temperature above the evaporation temperature of the finishing substance.

By virtue of the invention the evaporated finishing substance dissolved directly from the vapor phase in the material of the synthetic fiber heated to the treatment temperature without interim resublimation, condensation or the like. Since the evaporation or sublimation temperature or the dew point and thereby, the resublimation temperature of the finishing substance is below the treatment temperature of the textile material, neither condensation nor resublimation can occur. Every individual molecule of the vapor-deposited finishing substance therefore is diffused immediately into the synthetic-fiber substrate as it strikes it. Practically immediately after the vapor deposition, there is therefore no longer any danger of smudging or smearing of the finishing substance on the textile material.

In pertinent treatment methods customary heretofore in textile technology, the finishing substance is applied in a carrier phase, for instance, in water as the transport medium, in liquid or foamed form, to the textile material and the latter is then heated to the treatment temperature, optionally after a drying phase or the like. According to the invention, the textile material is first heated to the treatment temperature and the heated textile material exposed only then to the vaporous finishing substance.

According to "Textilpraxis International", 1972, pages 540 and 541, the dyeing from the liquid phase is ultimately accomplished via the vapor phase of the applied dye; the transition of the dye to the vapor phase is therefore to be the speed-determining step in the fixation process. According to the invention, a practically instant penetration of the evaporated material into the individual fibers is achieved if evaporated finishing substance present in monomolecular form meets the textile material heated to the treatment temperature. The treatment is therefore completed practically immediately after the vapor deposition of the finishing substance. Only a brief post-treatment may follow, in which an opportunity is given to the individual particles of the finishing substance to distribute themselves uniformly down into the core of the fiber.

Contrary to all known treatment method of the present kind, caution prior to or during contact with the surface of the textile material is not necessary, according to the invention, immediately after vapor-depositing the finishing substance. Also re-evaporation from the substrate surface does not occur to an appreciable degree since in the evaporation zone the vapor pressure of the finishing substance is higher outside the fiber than inside the fiber and the particles of the finishing substance are already located within the respective fiber when the textile material leaves the evaporation zone.

In order to essentially prevent contamination of the preferably continuously operating treatment unit, the finishing substance vapor is brought to the vapor deposition zone, according to a further embodiment, by means of a separate nozzle system. The nozzle system is to be heated here such that the gaseous finishing substance is not condensed at the walls, as far as possible.

Apparatus for carrying out the method is characterized in a continuously-operating unit substantially by a finishing machine extending in the travel direction of the textile material, for instance, a tenter, a hot flue or the circumference of a perforated-drum fixing machine with a finishing-substance application system which is integrated into the treatment path but has separate feed and discharge lines. This system is preferably arranged at that point of the treatment path within the finishing machine, at which the textile material to be treated has just reached the treatment temperature.

It is a particular value of the present method that the vapor depositing of the finishing substance can also be accomplished immediately following, i.e., already outside the machine used for heating to the treatment temperature, so that contamination of this machine by the finishing-substance vapor is impossible. If subsequently to the vapor deposition on the fiber which is already heated to the treatment temperature, a brief post-treatment is necessary, a continuously traversed post-treatment unit can be connected to the preferably separate evaporation zone. In many cases, however, this unit can be omitted, and the textile material can be taken, directly following the vapor deposition, to interim storage with unwinding or rolling-up or, possibly after cooling-down, to further processing.

Further details of the invention will be explained with the aid of the schematic drawing of an embodiment example.

In the attached drawing, apparatus for carrying-out the method with textile material 1 continuously passed-on in the direction of the arrow is shown. The textile material is taken through a continuously operating machine, in which a heating-up zone 2, a vapor deposition zone 3 and optionally, a post-treatment zone 4 follow each other. The individual zones 2 to 4 can lie, as in a tenter or infrared frame, in a horizontal or vertical plane (as in a hot flue), can follow each other on a path to be traversed along a wavy line, or arranged on parts of a circular track as on the circumference of a perforated drum.

In the heating-up zone 2, the textile material 1 is heated up, for instance, by exposure to hot gas or by radiation heating (infrared shaft) to the treatment temperature typical of the textile fiber and the finishing substance, so that the textile material 1 arrives at the transition 5 between the heating-up zone 2 and the vapor deposition zone 3 in the vapor deposition zone 3 at the treatment temperature. There, finishing substance vapor is transported by means of a gas stream to a nozzle system 7 pointing toward the textile material 1, via line system 6. Because of the ideal conditions prevailing within the vapor deposition zone 3 for the migration of the finishing substance into the individual textile fibers, the textile material can be taken in very many cases to further processing or interim storage immediately after leaving the vapor deposition zone 3.

In order to avoid the passage of the finishing substance vapor from the vapor deposition zone 3 into the heating-up zone 2 (and, if applicable, into the post-treatment zone 4), locks are provided at the input and output of the vapor deposition zone 3 and advantageously also at the adjoining openings to the heating-up zone 2 and the post-treatment zone 4. These locks permit the passage of the textile material without a hitch, but represent a distinct obstacle to the continued flow of the finishing substance vapor from the treatment zone 3. In these locks 8 and 9, the textile material 1 can also be touched without the danger of smudging or smearing, since the textile material 1 is not yet vapor-deposited at the lock 9 at the output of the heating-up zone 2, while at the lock 8 at the input of the post-treatment zone 4, the finishing substance has areas of the textile material to be finished, i.e., to be upgraded, to be dyed or to be optically brightened, or the like.

In vapor-depositing on the textile material, the amount of vapor fed-in can be chosen so, at least after a few tests, that the desired finish effect is achieved and at the same time, excess treatment medium does not remain on the fiber. Therefore, reductive cleaning and/or subsequent rinsing such as is necessary in known finishing processes such as dyeing as a rule, can be omitted, with the result that the cost for this post-treatment, for instance, washing as well as, optionally, subsequent drying and also corresponding loading of the waste water are eliminated altogether.

According to the present method, plain finishes and especially solid dyeing as well as patterns can be made. By suitably programmed motion of one or more vapor application nozzles in the vapor deposition zone, patterns or pictures of arbitrarily variable shape can also be produced.

There is claimed:

1. Method for finishing textile material containing synthetic fibers, especially a web of textile cloth, with an evaporable finishing medium forming a solid solution with the material of the synthetic fibers, which comprises, evaporating the finishing medium out of contact with the textile material to be finished, heating the textile material prior to making contact with the evaporated finishing medium to a treatment temperature required for dissolving the finishing medium in the synthetic fiber, transferring the finishing medium in the vapor phase by means of a transport gas to the textile material unimpeded by a heat transfer solid carrier, and wherein the finishing medium has a dew point in the finishing medium/transport gas mixture below the treatment temperature of the textile material to cause dissolving without condensation of the finishing medium vapor in the synthetic fiber.

2. Method according to claim 1, wherein contact of said vapor phase to the textile material take place in a continuously-operating treatment unit by means of a separate nozzle system at that point at which the textile material has just reached the treatment temperature.

* * * * *